11/25/86 XR 4,624,641

United States Patent [19]

Gallagher

[11] Patent Number: 4,624,641

[45] Date of Patent: Nov. 25, 1986

[54] LASER SIMULATOR FOR A FIRING PORT WEAPON

[75] Inventor: Lawrence J. Gallagher, Arcadia, Calif.

[73] Assignee: Loral Electro-Optical Systems, Pasadena, Calif.

[21] Appl. No.: 663,226

[22] Filed: Oct. 22, 1984

[51] Int. Cl.[4] ..... F41G 3/22

[52] U.S. Cl. ..... 434/21; 273/310; 434/19; 33/233

[58] Field of Search ..... 434/16, 17, 19, 21, 434/22, 26; 33/233, 235, 237, 241, 244; 250/505.1, 515.1; 350/616; 273/310–316

[56] References Cited

U.S. PATENT DOCUMENTS 3,997,762 12/1976 Ritchie et al. ..... 33/235

4,052,124 10/1977 Marcus ..... 350/616

*Primary Examiner*—Leo P. Picard

*Attorney, Agent, or Firm*—Spensley Horn Jubas & Lubitz

[57] ABSTRACT

A live ammunition optical simulator for a weapon disposed in a gun port and aimed through a separate view point. The simulator includes a visible light source, an infrared laser and a beam splitter located adjacent the view port and between the visible light source and the laser. The visible light source and the laser are oriented so that their respective beams lie along a common axis and strike opposing sides of the beam splitter. The laser beam is reflected by the beam splitter out of the view port to simulate the point of impact of a weapon projectile. The visible light beam is reflected by the beam splitter to a weapon user to provide a visual aiming cue simulating the path of a weapon projectile tracer. The weapon user, observing the scene shown in the view port through the beam splitter, can determine the point of impact of the laser beam by orienting himself so as to observe the visible light beam reflection in the beam splitter. A co-moving linkage, detachably connected to the weapon, effects pivotal rotation of the beam splitter to reflectively direct the laser and visible light beams in response to movement of the weapon.

10 Claims, 5 Drawing Figures

LASER SIMULATOR FOR A FIRING PORT WEAPON

BACKGROUND OF THE INVENTION

1. Field of the Invention.

The present invention concerns infrared laser devices used to simulate live ammunition in weapons during military training exercises and, more particularly, a laser simulator device for firing port weapons.

2. Description of the Prior Art.

Small infrared laser weapon simulators are commonly used in a number of military battlefield training exercises such as mock combat. Typically a small infrared laser transmitter is affixed to the barrel of a weapon and aligned with the weapon sighting system. These laser transmitters discharge a brief pulse of infrared radiation in the direction the weapon is aimed, giving an indication of the point of impact for a hypothetically fired weapon projectile. Combatants wear a sensor array, typically on a harness and helmet, to detect irradiation by the laser transmitters. Electronic circuits used in conjunction with the sensors detect sensor illumination by a laser pulse and register a "hit" or a "near miss" depending on the degree of sensor illumination. When registering a "hit," some of these electronic devices sound an audio alarm that can only be silenced by deactivation of the stricken combatant's own weapon laser transmitter.

In some applications, the laser transmitter is activated by an audio report caused by the discharge of a blank cartridge in the weapon. This adds to exercise realism by limiting the number of times the laser transmitter can be "fired" to the amount of blank ammunition issued to a combatant during the course of a training exercise. Using these laser transmitters and sensors, training exercise combatants are provided with a system for assessing their accuracy against "hostile" forces and their own survival skills in combat.

In some systems, such as the Multiple Integrated Laser Engagement System (MILES), developed by Loral Corporation, the laser transmitter emits an encoded pulse of infrared radiation corresponding to the type of weapon system employed. Dedicated laser transmitters having weapon specific encoding are presently used in connection with a virtually complete hierarchy of military weapons systems ranging from small arms and light automatic weapons up through various types of mobil artillery and precision guided munitions as well as various types of anti-aircraft and anti-armor weapons.

In the MILES system, sensors and associated electronic circuits are provided for armored vehicles and aircraft which are capable of discerning between illumination by small arms encoded laser transmitter simulators and anti-armor or anti-aircraft encoded laser transmitter simulators. Thus, these detection systems can discriminate between relatively ineffective small arms fire and "hits" or "near misses" by potentially "lethal" anti-armor or anti-aircraft laser transmitter simulators. Some weapon systems, however, have not been amenable to the application of laser simulators. One such weapon system is the firing port weapon.

Firing port weapons are typically light automatic weapons fired through a gun port and aimed through a separate view port. These weapons are usually employed in armored vehicles such as, for example, the M2/M3 Bradley Fighting Vehicle. The gun port is usually an armored ball and socket assembly with the firing port weapon removably disposed through an armored ball subassembly. Typically an armored vehicle will have a number of gun ports for use with one or more firing port weapons stored within the vehicle. A view port is usually located in proximity to each gun port. These view ports typically include a rugged periscope assembly disposed through an armored surface of the vehicle to provide a view from a slight distance above or to one side of the gun port.

Since the firing port weapon is usually disposed through an armored ball subassembly, the weapon cannot be aimed by simply sighting along the length of the weapon barrel. As an aid to weapon aiming, firing port weapons generally fire tracer ammunition. The weapon user can observe a tracer bullet passing through the air in the view port and aim the firing port weapon by directing the briefly observed tracer paths toward his target. Typical firing port weapon users achieve only poor accuracy without using tracer ammunition as an aiming cue.

Firing port weapons are not amenable to standard laser weapon simulators since simply affixing a laser transmitter to a forward portion of the weapon barrel provides no aiming cue for the weapons user. Further, affixing a laser transmitter to the exterior barrel precludes removal of the firing port weapon from one gun port and insertion in another gun port without first disengaging and then reattaching the laser transmitter. In addition, standard laser transmitters are susceptible to disablement in the harsh environment frequently encountered immediately exterior to an armored vehicle in a combat setting.

Thus, there exists a need for a laser simulator for firing port weapons so that such weapons can be used in training exercises, yet no laser transmitter simulator has previously been developed which can successfully serve this purpose. Such a firing port weapon laser simulator should provide an aiming cue for the weapon user and permit exchange of the firing port weapon from one gun port to another. The laser simulator should also have the capacity to "fire" at the discharge of blank ammunition in the firing port weapon.

SUMMARY OF THE INVENTION

It is, therefore, an object of the present invention to provide a laser simulator for firing port weapons. A further objective of the present invention is to provide a firing port weapon laser simulator with a visual aiming cue for the weapon user which simulates the brief flash of a "tracer" round. A still further objective of the present invention is to provide a firing port weapon laser simulator able to permit firing of blanks in the weapon to trigger the laser simulator. Yet another objective of the present invention is to provide a firing port weapon laser simulator permitting exchange of the firing port weapon from one gun port to another without disengaging the laser simulator.

To accomplish the foregoing and other advantages and objectives, the firing port weapon laser simulator of the present invention, in its preferred embodiment, includes a housing mounted within a firing port vehicle adjacent a firing port weapon view port. The housing has a first viewing aperture and a second viewing aperture, opposite the first viewing aperture, so that the field of view for a weapon user looking through the view port periscope is virtually unobscured. A pulsed infrared laser and a pulsed visible light source are mounted within the housing at opposing ends and oriented so that the laser and visible light source direct their respective beams toward one another along a common axis. A partially reflective mirror, or beam splitter, is pivotally disposed within the housing between the laser and the visible light source. This beam splitter is oriented so as to reflect the visible light source beam through the second viewing aperture toward a weapons user while reflecting the infrared laser beam through the first viewing aperture and the view port periscope to a target beyond the armored vehicle. A co-moving linkage is detachably coupled to the firing port weapon and connected to the beam splitter and housing so that the paths of the laser beam and visible light source beam are directed by movement of the weapon. Thus, the laser beam is directed out of the periscope view port to simulate firing of the firing port weapon by activating sensors worn by training exercise combatants while the visible light beam is directed to the weapon user to provide a visible aiming cue.

The novel features which are believed to be characteristic of the invention, together with further objectives and advantages thereof, will be better understood from the following description considered in connection with the accompanying drawings, wherein like numbers identify like elements. It should be expressly understood, however, that the drawings are for purposes of illustration and description only and are not intended as a definition of the limits of the invention.

DETAILED DESCRIPTION

Figure 1:
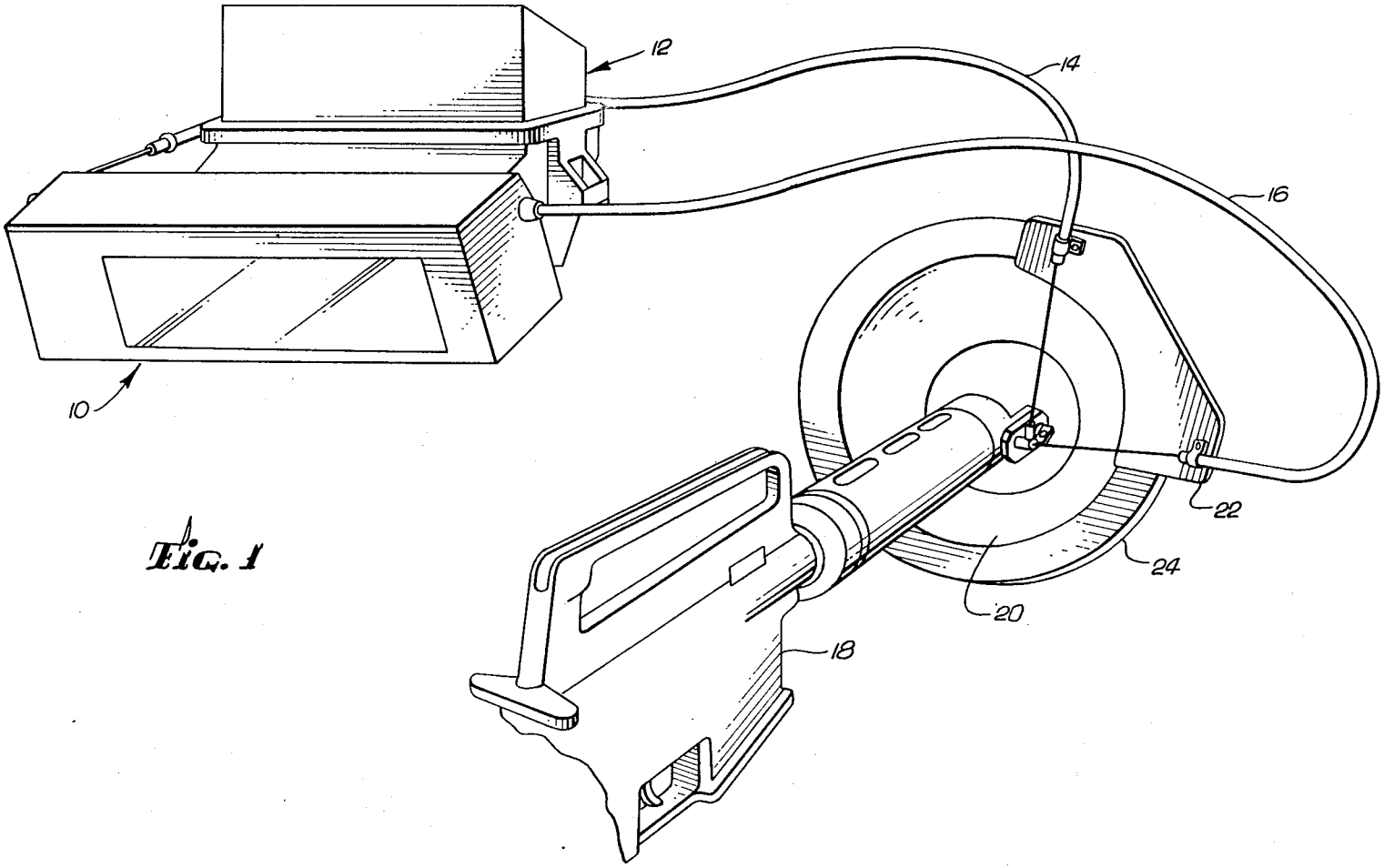
FIG. 1 is a general perspective view of a preferred embodiment of the present firing port weapon simulator shown adjacent a view port periscope and to a firing port weapon inserted in a vehicle gun port.

Referring now to the figures, and more particularly FIG. 1 thereof, there is shown a preferred embodiment of the present inventive firing port weapon simulator for a firing port vehicle. A simulator housing 10, having disposed therein an infrared laser and supporting optics, is disposed adjacent a firing port weapon view port periscope 12. Co-moving cables 14, 16 attached to the housing 10 and a firing port weapon 18 (shown disposed through a gun port 20) transmit movement of the firing port weapon 18 to the housing 10 and the optics located therein. The cables 14, 16 are secured adjacent the firing port weapon 18 by attachment to an adaptor plate 22 connected to a gun port mounting ring 24.

Figure 2:
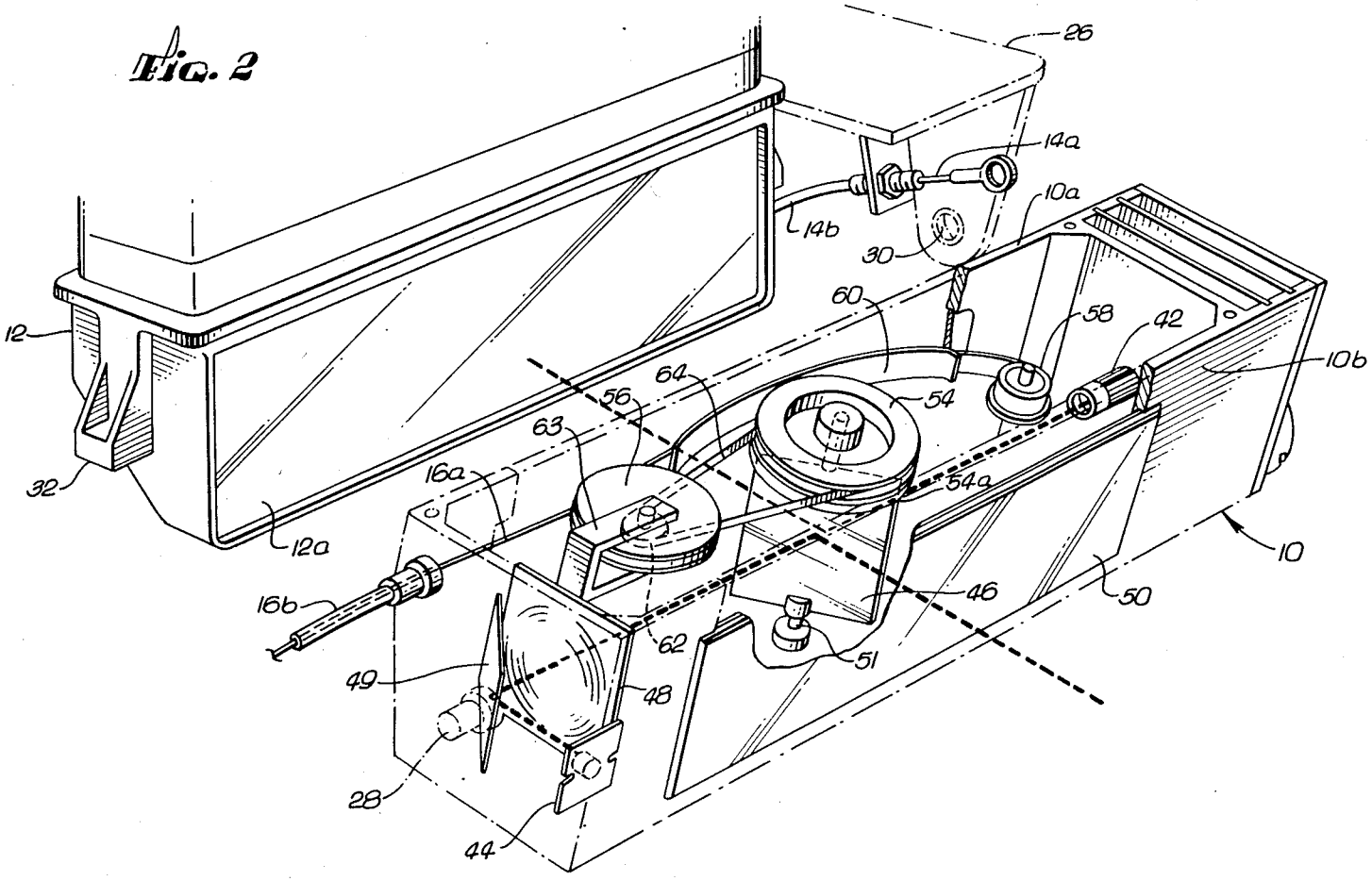
FIG. 2 is a cutaway perspective view of the interior of the firing port weapon simulator housing.

As shown in FIG. 2, the housing 10 is pivotally coupled to a housing mount 26 by two pivot shafts 28 attached to opposite ends of the housing 10 and disposed through bores 30 located in the housing mount 26. The housing mount 26 is preferably bolted to conventional mounting tabs 32 projecting from opposing sides of the view port periscope 12. Preferably a flexible dust boot (not shown) is connected to the housing 10 and the view port periscope 12 to avoid the accumulation of dust on a viewing surface **12*a* of the view port periscope 12**.

Figure 3:
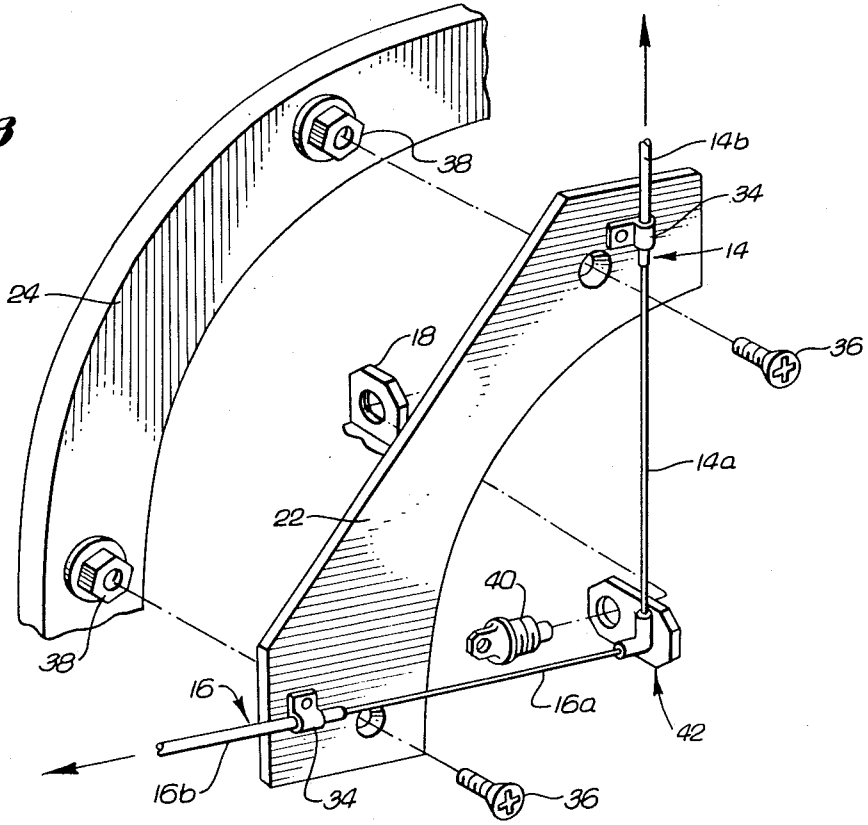
FIG. 3 is an exploded view of the co-linkage mounting assembly securing co-moving linkage cables to the vehicle gun port.

Referring now to FIG. 3, the co-moving cables 14, 16 are shown to include inner cables **14*a*, 16*a*, respectively disposed within cable sheaths 14*b*, 16*b*. The cable sheaths 14*b*, 16*b* are attached to the adapter plate 22 by brackets 34. The adapter plate 22 is attached to the gun port mounting ring 24 by screws 36 threaded into modified ring bolts 38. These ring bolts 38 have been provided with a threaded bore to receive screws 36**.

The inner cables **14*a*, 16*a* are connected to the firing port weapon 18 by attachment to a block 42 which is detachably coupled to a retention pin 40. Retention pin 40 is removably connected to a forward portion of the firing port weapon 18 and used to secure the firing port weapon 18 in the gun port 20. Thus, the inner cables 14*a*, 16*a* can be disengaged from the firing port weapon 18 by removing retention pin 40 from the forward portion of weapon 18**.

Co-moving cable 14 translates vertical movement of the firing port weapon 18 into rotation of the housing 10 about a horizontal axis. As shown in FIG. 2, cable sheath **14*b* is connected to housing mount 26 with inner cable 14*a* appropriately attached to housing 10. The point of attachment of inner cable 14*a* to housing 10 is selected so that approximately 1.5 inches of travel of the firing port weapon in a vertical plane translates into approximately 9° of horizontal pivotal rotation of housing 10. A spring (not shown) is disposed between the housing 10 and housing mount 26 to provide constant tension for inner cable 14*a*. Cable sheath 16*b* is connected to the side of housing 10**.

The housing 10 has a first aperture in a housing wall **10*a* facing towards the viewing port periscope 12 and a second aperture in a housing wall 10*b* opposite the first aperture. A low power infrared laser 42, visible light source 44, and partially reflecting mirror 46 are disposed within housing 10. The infrared laser 42 and visible light source 44 are located at opposing ends of the housing 10 and oriented so that the propagation path for the visible light source beam and the infrared laser beam in the housing lie along the same axis. The partially reflecting mirror 46 is pivotally mounted in approximately the middle of the housing 10. Inner cable 16*a* is coupled to the partially relfective mirror 46 so as to translate horizontal movement of the firing port weapon 18 into rotation of the partially reflecting mirror 46** about a vertical axis.

Infrared laser 42 is a standard MILES type laser, typical of those used in conventional laser weapon simulator devices. The visible light source 44 can be of any appropriate type. In the presently preferred embodiment, visible light source 44 is a conventional light emitting diode.

The partially reflecting mirror 46 is selected to permit a view of the scene observed through the view port periscope 12 while reflecting a portion of both the visible light source beam and infrared laser beam off its planar surfaces. Partially reflecting mirrors of this type are commercially available, one example being a "Heat Reflecting Mirror" manufactured by Rolyn Corporation and designated Part No. 66.2475.

To collimate the visible light source beam, a fresnel lens 48 is disposed between the partially reflecting mirror 46 and the visible light source 44, with the visible light source 44 located at the focal point of the fresnel lens 48. To minimize the length of housing 10, the optical path of the visible light source beam to the fresnel lens 48 is folded by attaching the visible light source 44 to the housing wall 10*b* and positioning a mirror 49 to reflect the visible light source beam to the fresnel lens 48.

The partially reflecting mirror 46 is oriented so that the infrared laser beam, emanating from one end of the housing 10, is reflected off a first planar surface of the partially reflecting mirror 46 through the first housing aperture and out the view port periscope 12, to strike some point outside the firing port vehicle. The visible light source beam, emanating from an opposite end of the housing 10, is reflected off an opposing second planar surface of the partially reflecting mirror 46 through the second housing aperture to a firing port weapon user. Assuming the first and second surfaces of the partially reflecting mirror 46 are relatively parallel, the axis of the propagation path for the visible light source beam and the infrared laser beam, both reflected off the partially reflecting mirror 46, are approximately parallel. Thus, a firing port weapon user, orienting himself so as to see the visible light source beam reflected off the partially reflecting mirror 46, will observe that visible light beam reflection as the point of impact for the infrared laser beam outside the vehicle. As viewed through the housing apertures, the reflected visible light source beam will be superimposed on an exterior scene presented through the partially reflecting mirror 46 and the view port periscope 12. If the visible light source is pulsed along with the infrared laser, the flickering image will simulate a tracer flash.

Since some infrared laser radiation is reflected off the view port periscope viewing surface 12*a*, an infared absorbing window 50 is disposed over the second housing aperature. This provides a safety measure for the weapon user and avoids accidental activation of any sensor arrays worn by personnel within the firing port vehicle.

As discussed above, the partially reflecting mirror 46 is pivotally disposed within the housing 10. The lower portion of the partially reflecting mirror 46 is attached to a pivot shaft 51 rotatably mounted to the floor of housing 10. The upper portion of partially reflecting mirror 46 is attached to a pulley 54 along a flange portion 54*a*. Mirror pulley 54 is rotatably mounted to the ceiling of housing 10. To effect rotation of the partially reflecting mirror 46, cable sheath 16b is attached to the exterior of housing 10 and inner cable 16*a* wrapped 360° around a first pulley 56 and attached to a constant tension coil spring 58. Constant tension spring 58 is mounted to the housing ceiling on one side of the partially reflecting mirror 46 opposite the first pulley 56. A guide 60, also mounted on the housing ceiling, precludes contact of the inner cable 16*a* with the mirror pulley 54. A second pulley 62 (shown in broken lines) is connected coaxially to the first pulley 56. Both first pulley 56 and second pulley 62 are pivotally disposed in a bracket 63, mounted to the ceiling of housing 10. A belt 64 connects second pulley 62 with mirror pulley 54. Thus linear movement of inner cable 16*a* effects a rotation of first pulley 56 and second pulley 62. Rotation of pulley mirror 56 is, in turn, caused by belt 64 moving in response to the rotation of second pulley 62. The ratio of diameter for the first pulley 56 and second pulley 62 is chosen so that about 1.5 inches of weapon travel in a horizontal plane produces approximately 15° rotation of the partially reflecting mirror 46 about a vertical axis.

In operation, movement of the firing port weapon 18 in a vertical plane causes inner cable 14*a* to rotate the housing 10 about a horizontal axis, thus effecting the vertical location of the point of impact for the infrared laser beam at some point exterior to the firing port vehicle. Similarly, movement of the firing port weapon 18 in a horizontal plane causes inner cable 16*b* to rotate partially reflecting mirror 46 about a vertical axis, thus effecting the horizontal location of the point of impact for the infrared laser beam at some point exterior to the vehicle. A firing port weapon user is able to view this point of impact for the infrared laser beam by orienting himself so as to observe the image of the visual light source beam reflected off the partially reflecting mirror 46 and superimposed on the view seen through the view port periscope 12.

In an alternative embodiment of the present invention, three partially reflecting mirrors could be pivotally mounted in the housing 10 in parallel side by side relationship. The three mirrors would be coupled to one another so as to maintain their parallel orientation with respect to one another during pivotal rotation. The field of view of the visible light source beam for a firing port weapon user would then be increased since the visible light source beam could be observed reflecting off of any one of the three partially reflecting mirrors. The partially reflecting mirror closest to the infrared laser could be used to reflect the infrared laser beam out of the housing and through the view port to a target.

Figure 4:
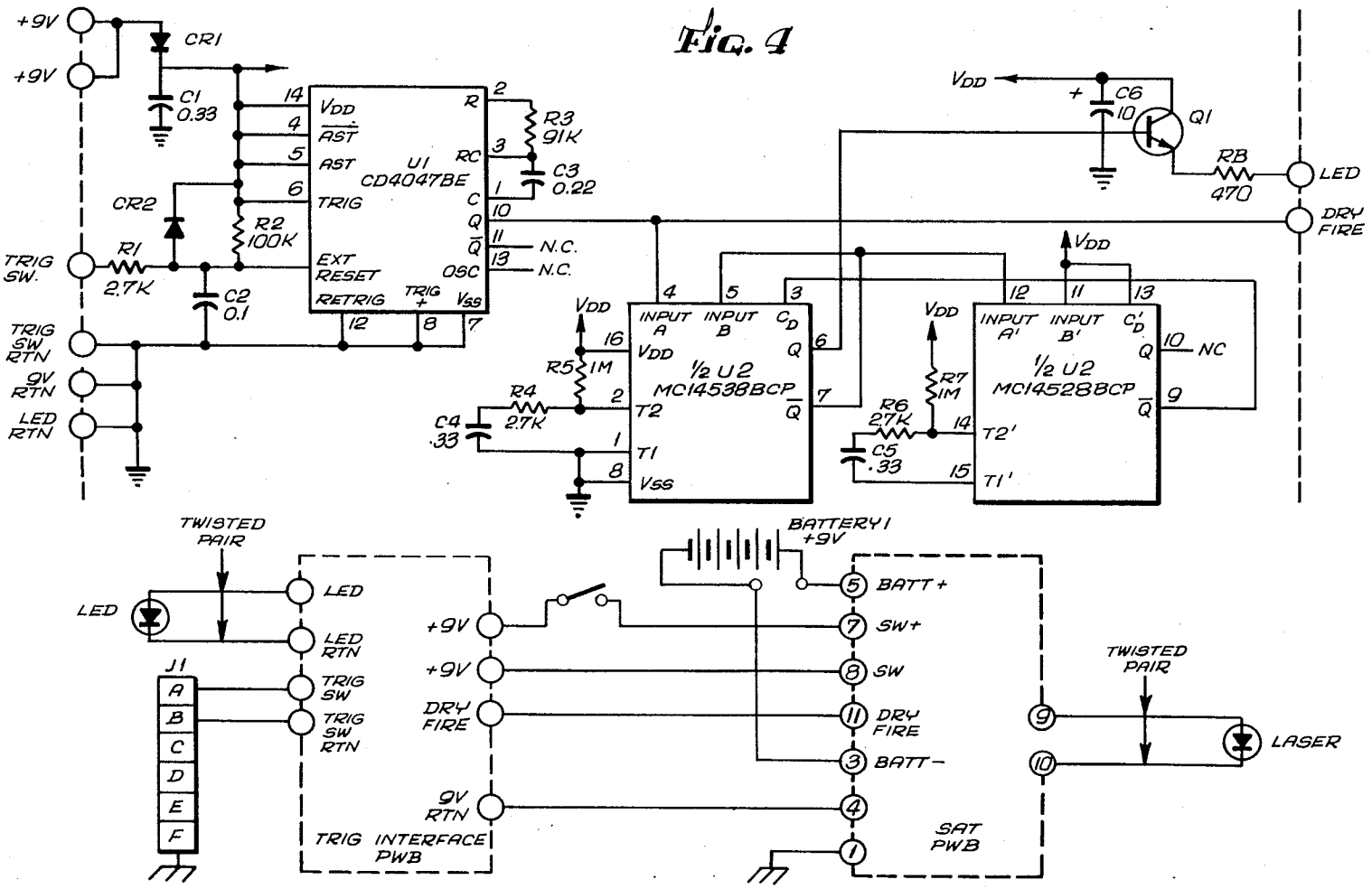
FIG. 4 is a schematic diagram of an electronic circuit for triggering the firing port weapon simulator laser and visible light source.

The infrared laser 42 is driven by a conventional electronic circuit used in standard MILES infrared laser transmitter simulators. The electronic circuit used to drive the visible light source 44 (a conventional light emitting diode) is shown in FIG. 4. To assist in familiarizing the firing port weapon user with the firing port weapon laser simulator of the present invention, this circuit also includes a "automatic fire" function which can be "locked out" during actual combat exercises. In FIG. 4, U1 is an astable multivibrator which provides a square wave of approximately 11 hertz as long as the firing port weapon trigger is depressed. The square wave is sent to the "dry fire" input of the conventional infrared laser driver board and causes it to pulse the laser at a rate of approximately 650 pulses per minute. U2 is a dual monostable multivibrator configured to provide a "slow" square wave to input Q1. This drives the light emitting diode, acting as the visible light source 44, so as to provide a flickering image simulating the flashes of tracer rounds fired through the firing port weapon 18.

Figure 5:
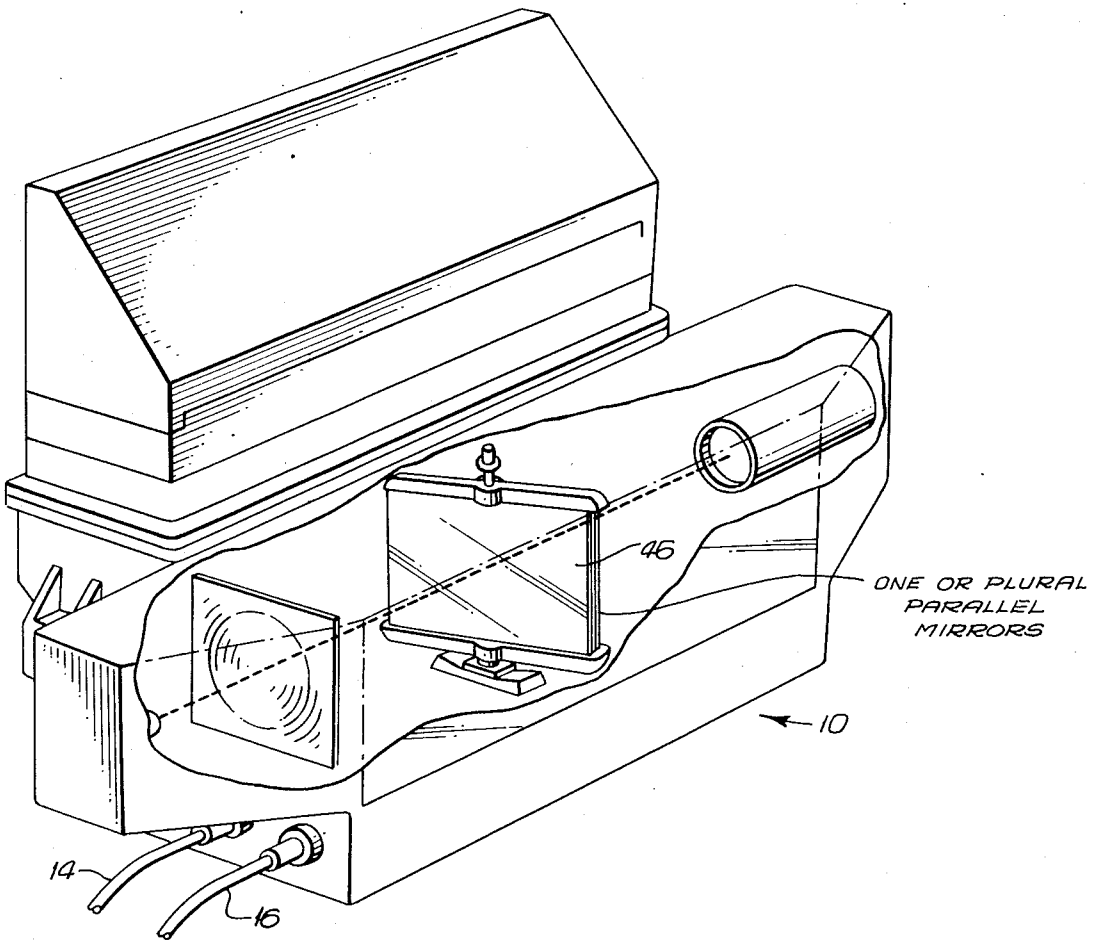
FIG. 5 is a cutaway perspective view of an alternative embodiment of a firing port weapon simulator.

The present inventive firing port weapon simulator is adaptable to any kind of weapon fired through a first port while aimed through a second port. Such weapons are not limited to the kind of light automatic weapon shown in FIG. 1. It will, of course, be understood that other modifications of the present inventive firing port weapon laser simulator will be apparent to those skilled in the art. For example, rather than having co-moving cable 16 pivot the partially reflecting mirror 46 about a vertical axis and co-moving cable 14 pivot the housing 10 about a horizontal axis, these cables could both be coupled to partially reflecting mirror 46 as indicated in shown in FIG. 5. Co-moving cables 14, 16 would then respectively effect horizontal and vertical pivotal movement of partially reflecting mirror 46 alone. Alternatively, co-moving cables 14, 16 could be replaced with conventional electro-mechanical distance sensing devices to measure the movement of the firing port weapon 18 within the gun port 20 and effect appropriate pivotal movement of the partially reflecting mirror 46. Consequently, the scope of the present invention should not be limited by the particular embodiments described above, but should be defined only by the claims set forth below and equivalents thereof.

What is claimed is:

1. A weapon simulator for a firing port weapon fired through a gun port and aimed through a separate view port, comprising:

(a) a housing, mounted adjacent the view port, having a first wall adjacent the view port defining a first viewing aperture and a second wall, oposite the first wall, defining a second viewing aperture;

(b) a laser for simulating weapon firing mounted within the housing;

(c) a stationary visible spot light source for aiding in weapon aiming, mounted within the housing such that the laser and visible light source direct their respective beams towards each other;

(d) a partially reflective mirror rotatable mounted within the housig between the laser and the visible spot light source, said mirror reflecting the visible light beam through the second viewing aperture toward a weapon user and the laser beam through the first viewing aperture and the view port;

(e) a co-moving linkage connecting the weapon and the mirror for coordinated movement of the mirror in correspondence with movement of the weapon, the laser beam and visible light source beam thereby being reflectively directed by the movable mirror in coordination with movement of the weapon, so that the weapon user sees the actual visual target background through the second viewing aperture, the mirror, the first viewing and the view port, and sees superimposed on said visual background an aiming spot comprising the beam from the stationary visible spot light source reflected by said mirror through said second viewing aperture to said user, movement of said mirror in coordination with movement of the weapon causing the beam from the stationary spot light source to be reflected at a different angle to the weapon user, so that said aiming spot appears to the user to move across the visual backgrund, the position of the reflected spot coinciding with the direction of the laser beam refleted toward the target, so that as the laser beam simulates firing of the weapon, the reflected visible light beam from the stationary spot light source present a visible aiming cue to the weapon user; and (f) electronic means for actuating the laser and the visible light source.

2. The weapon simulator of claim 1 further comprising an infrared radiation absorbing window mounted adjacent the second housing wall aperture, said window being generally transparent to visible light.

3. The weapon simulator of claim 1 further comprising:

(a) at least two partially reflective mirrors rotatably disposed within the housing in parallel orientation; and (b) coupling means for moving the mirrors in unison while maintaining the parallel orientation between the mirrors.

4. The weapon simulator of claim 1 further comprising a collimating lens mounted within the housing between the visible light source and the partially reflective mirror such the visible light source is at the focal point of the lens, wherein the visible light source beam directed to the weapon user is collimated.

5. A weapon simulator for use with a firing port weapon fired through a gun port and aimed through a separate view port, comprising:

(a) a housing, mounted adjacent the weapon view port, said housing having a first wall adjacent the view port defining a first viewing aperture and a second wall, opposite the first wall, defining a second viewing aperture;

(b) a laser for simulating weapon firing mounted within the housing;

(c) a visible light source for aiding in weapon aiming, mounted within the housing such that the laser and the visible light source direct their respective beams towards each other;

(d) a partially reflective mirror rotatably mounted within the housing between the laser and the visible light source so as to rotate about a first generally horizontal axis and a second generally vertical axis, reflecting a visible light beam from the visible light source through the second housing viewing aperture to a weapon user and a laser beam from the laser through the first housing viewing aperture and the view port; and (e) means, connected to the mirror and cooperating with the weapon, for directing the orientation of the partially reflective mirror in response to movement of the weapon such that the laser beam and the visible light source beam are directed by movement of the weapon, wherein the laser beam simulates firing of the weapon and a visible light beam presents an aiming cue to a weapon user.

6. The weapon simulator of claim 5 further comprising an infrared radiation absorbing window mounted adjacent the second housing wall aperture, said window being generally transparent to visible light.

7. The weapon simulator of claim 5 further comprising:

(a) at least two partially reflective mirrors disposed within the housing and in parallel orientation; and (b) coupling means for moving the mirrors in unison while maintaining the parallel orientation between the mirrors.

8. The weapon simulator of claim 5 further comprising a collimating lens mounted within the housing between the visible light source and the partially reflective mirror such the visible light source is at the focal point of the lens, wherein the visible light source beam directed to the weapon user is collimated.

9. A live ammunition simulator for a weapon to be aimed toward a target background, comprising:

a partially transparent, moveable mirror mounted to permit a weapon user to view said target background through said mirror;

a laser mounted laterally at one side of said moveable mirror;

a stationary visible spot light source mounted laterally at the other side of said moveable mirror;

said moveable mirror being mounted with respect to said laser and said light source so as to reflect a beam from said laser toward said target background and to reflect a visible light spot from said source in a direction opposite said reflected laser beam toward said weapon user; and interconnecting means for moving said mirror in accordance with movement of said weapon, so that the reflected beam simulates ammunition fired by said weapon and said reflected visible light spot from said stationary spot light source appears to move across said target background as said weapon and said mirror are moved, thereby simulating to the weapon user an ammunition tracer.

10. A simulator according to claim 9 and intended for use with a firing port weapon mounted in spatial separation from a view port through which the user can view a target, said mirror being mounted to reflect said laser beam toward said view port, said mirror being partially transmissive of visible light, so that said user can view said target through said mirror and said view port and will see said ammunition tracer simulating reflected visible light spot imperimposed thereon.

* * * * *